US005303977A

United States Patent [19]

Sereboff

[11] Patent Number: 5,303,977

[45] **Date of Patent: *Apr. 19, 1994**

[54] FLUID CUSHION SYSTEM

[76] Inventor: Joel L. Sereboff, 2215 Millridge Rd., Owings Mills, Md. 21117

[ * ] Notice: The portion of the term of this patent subsequent to Aug. 2, 2005, has been disclaimed.

[21] Appl. No.: 204,001

[22] Filed: Jun. 8, 1988

Related U.S. Application Data

[63] Continuation-in-part of Ser. No. 847,169, Apr. 2, 1986, Pat. No. 4,761,011.

[51] Int. Cl.[5] ..... A47C 7/02

[52] U.S. Cl. ..... 297/230.1; 297/284.6; 297/452.41; 297/284.5; 297/DIG. 3

[58] Field of Search ..... 297/DIG. 3, 230, 231, 297/284; 5/451, 455, 450, 452

[56] References Cited

U.S. PATENT DOCUMENTS

| | | | |
|---|---|---|---|
| 1,446,290 | 2/1923 | Dessau | 5/455 X |
| 4,042,988 | 8/1977 | Holliday | 5/450 |
| 4,688,283 | 8/1987 | Jacobsen | 5/455 X |
| 4,761,011 | 8/1988 | Sereboff | 297/284 X |

*Primary Examiner*—Peter R. Brown

*Attorney, Agent, or Firm*—Morton J. Rosenberg; David I. Klein

[57] ABSTRACT

There is provided a fluid cushion system (10) which includes a resilient fluid casing member (12) adapted to at least be partially filled with a liquid. The resilient fluid casing member (12) defines an internal chamber within which the liquid is maintained and is formed of a material which is impervious to liquid transport. The resilient fluid casing member (12) is insertable within a resilient housing (20) which provides structural support for the fluid casing member (12) substantially independent of a positional orientation of the fluid casing member (12). The resilient housing member (20) is generally formed of a open celled foam type elastic material and includes a cover (32) adapted to be releasably mounted to an external base member.

1 Claim, 3 Drawing Sheets

FLUID CUSHION SYSTEM

REFERENCES TO RELATED APPLICATIONS

This invention concept is a Continuation-in-Part Patent Application based upon Ser. No. 847,169, filed Apr. 2, 1986, entitled "WATER CUSHION STRESS-REDUCING ASSEMBLIES FOR CHAIRS AND OTHER SEATING DEVICES", now U.S. Pat. No. 4,761,011.

BACKGROUND OF THE INVENTION

1. Field of the Invention

This invention pertains to fluid cushion systems. In particular, this invention directs itself to fluid cushion systems wherein liquid is displaced to different positional locations within the fluid cushion system to minimize stress loading when particular portions of a user's body interface with the fluid cushion system. More in particular, the present invention directs itself to a fluid cushion system which includes at least one resilient fluid casing member which is insertable within a resilient housing. Still further, this invention directs itself to a fluid cushion system where the resilient housing provides for a structural support for the fluid casing member independent of the positional location and orientation of the resilient fluid casing member. Additionally, the subject invention relates to a fluid cushion system wherein the fluid cushion system includes a cover member adapted to be releasably secured to an external base member.

More in particular, this invention pertains to a fluid cushion system wherein there is provided an integrally molded closed contour flexible and resilient housing within which a plurality of fluid casing members may be removably inserted. Additionally, the fluid casing members are fluid impervious elements which may be formed in a molded one-piece formation. Still further, the subject invention concept directs itself to a fluid cushion system wherein the fluid casing members may be inserted within a multiplicity of compartments formed in the one-piece formed flexible and resilient housing. Still further, the subject invention directs itself to a fluid cushion system wherein fluid or liquid casing members include valve mechanisms to allow insert and removal of liquid responsive to the needs, comfort and structural support needed by the user at his or her discretion.

2. Prior Art

Fluid cushion systems utilizing a liquid to allow conformity to the human body as loads are applied thereto is known in the art. The best prior art known to the Applicant includes U.S. Pat. Nos. 3,984,886; 4,143,909; 4,189,181; 4,391,466; 4,108,492; 4,547,919; 3,867,732; 2,589,013; 2,867,266; 4,067,078; 3,348,880; and, 1,976,320.

In some prior art systems as described in U.S. Pat. No. 4,189,181, there are provided cushioning systems which rely upon displacement of contained atmospheres. However, such do not provide for an integrally molded entirely flexible assembly having a multiplicity of fluid impervious sections formed in a molded one-piece formation defining discrete pockets. Such prior art systems, do not allow for individual removal of fluid casing members for insert and/or removal of fluid to adjust to specific requirements of an individual. Additionally, such prior art systems do not provide for an external flexible housing which provides for a combined force load optimization and displacement of liquid contained within the system while providing additional structural support for flexible casings contained therein.

In other prior art systems such as that shown in U.S. Pat. No. 4,108,492, a plurality of inflatable cushions may be inserted into respective pockets on a back of a chair. However, in such prior art systems, the pockets receiving the inflatable cushions are sewn or otherwise attached to the front frame portions of the chair to form space compartments. Thus, such prior art systems do not provide for integrally formed and molded assemblies as provided in the subject invention concept to allow removal of the entire assembly or portions thereof from the system or the environment within which it is being used or to be adaptable for use in a variety of positional orientations. Further, in such systems, there is shown a structurally rigid frame for the back support and such does not allow for the flexibility of the subject fluid cushion system as is herein described.

In other prior art such as that shown in U.S. Pat. No. 3,867,732, pneumatic seat cushions are provided which have an air inlet stem projecting through portions in the upholstery and is coupled to a plurality of conduits. Such prior art seat cushions do provide for individual tube members however, such are not individually located within an overall discrete section, and flexible housing, as is necessary to the subject invention concept.

In further prior art systems, as is shown in U.S. Pat. No. 4,547,919, there are provided inflatable articles with some type of reinforcing structure. Although these references do provide a plurality of gas impervious sheets welded together at their edges to form compartment areas, it is clear that such do not provide for discrete or individual flexible casing members associated with these compartments for insert and/or removal from the compartments or pocket sections, as is necessary to the subject invention concept as herein described.

In other prior art fluid cushion systems, such are incorporated directly into a chair-like device or other furniture. Prior art systems of this type do not allow for removal and transportability of such fluid cushion systems at the discretion of the user.

SUMMARY OF THE INVENTION

A fluid cushion system is provided including at least one resilient fluid casing member adapted to be at least partially filled with a liquid. The fluid casing member is formed of a material composition which is impervious to the liquid contained therein. The fluid cushion system further includes a resilient housing for providing structural support for the fluid casing member which is substantially independent of a positional orientation of the fluid casing member. The fluid casing member is received within the resilient housing.

It is an object of the instant invention to provide a fluid cushion system which is transportable at the discretion of a user and may be removably secured to an external base surface. The external base surface may be the seat or back of a chair, a planar base surface such as flooring, or some other type of structural frame.

It is a further object of the present invention to provide a fluid cushion system which allows force interface with various portions of a user's body while reducing stress loading areas.

More in particular, this invention directs itself to a fluid cushion system which allows for displacement of liquid contained therein to allow conformance of the fluid cushion system to the natural undulations of a user's body.

It is another object of the subject invention to provide a fluid cushion system which will accomodate the seating of persons having sensitive areas which provide discomfort when rigid pressure points are applied to various portions of the user's body. The use of such fluid cushion systems may include use by burn patients, stroke victims, and the elderly, who are more sensitive to high levels of pressure within small areas of contact on particular points of their bodies.

It is a further object of the subject invention concept to provide a fluid cushion system which has sufficient structural integrity to maintain the loads applied thereto by interface with a user's body while simultaneously maintaining flexibility. In addition, the objective and purposes of the subject invention concept must be maintained in combination with the element structures which allow the overall system to be impervious to liquid transport therethrough.

It is another object of the subject invention concept to provide the overall fluid cushion system to be formed in a one-piece formation to allow such to be mounted on or constrained to an external base member such as a chair or other seating device.

Additionally, a still further objective is to allow a variability of the cushioning effect of the subject fluid cushion system at the discretion of the user. Thus, individual fluid casing members as provided in the subject invention concept must be provided for insert and removability from an overall flexible and resilient housing at the discretion of the user.

DESCRIPTION OF THE PREFERRED EMBODIMENT

Figure 2:
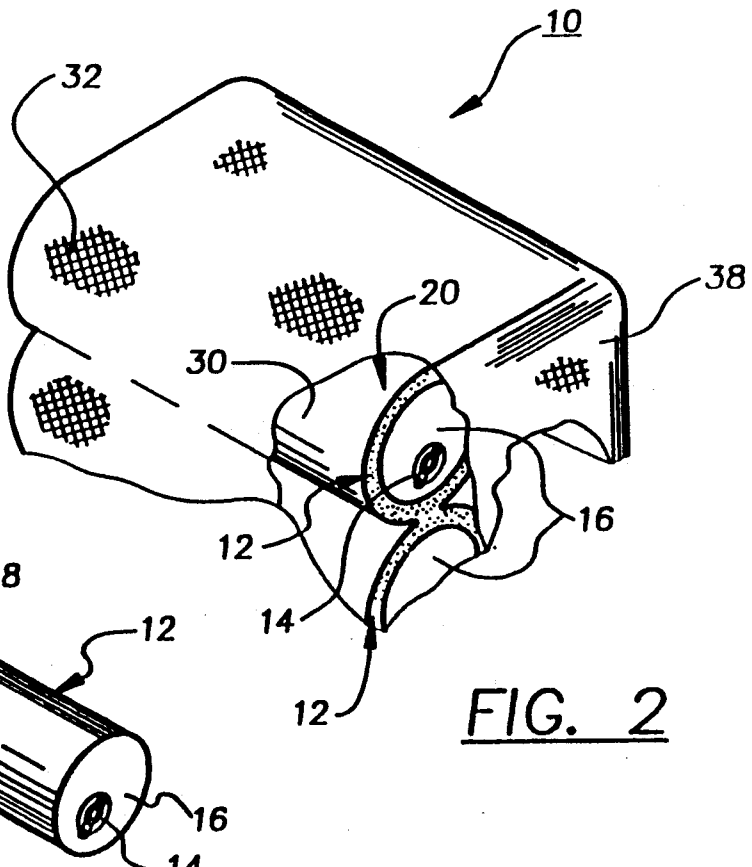
FIG. 2 is a perspective view partially in cut-away of a portion of the fluid cushion adapted for coupling to the back of a chair.
Figure 1:
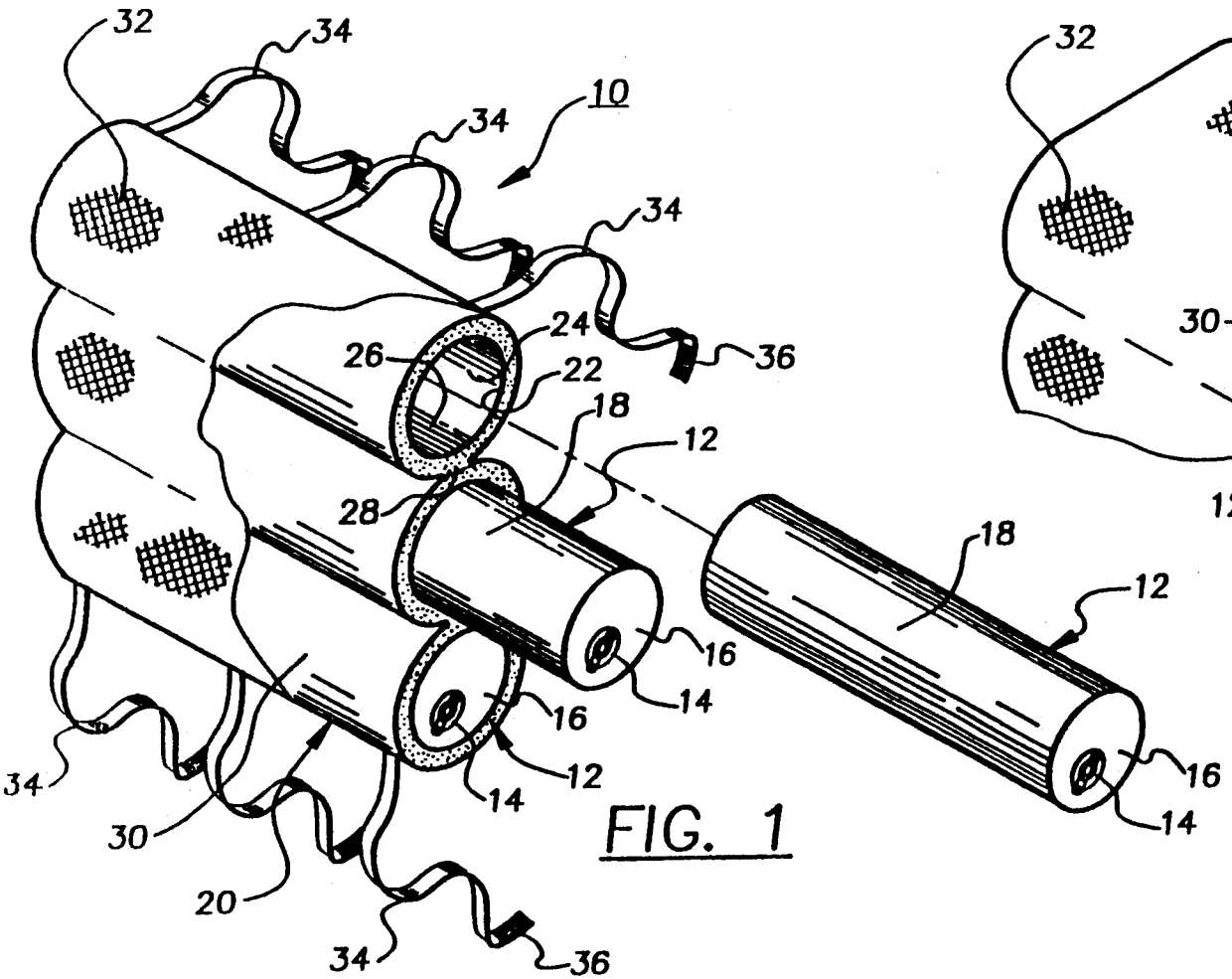
FIG. 1 is an exploded view of the fluid cushion system showing one of the resilient fluid casing members removed from the resilient enclosing housing.
Figure 4:
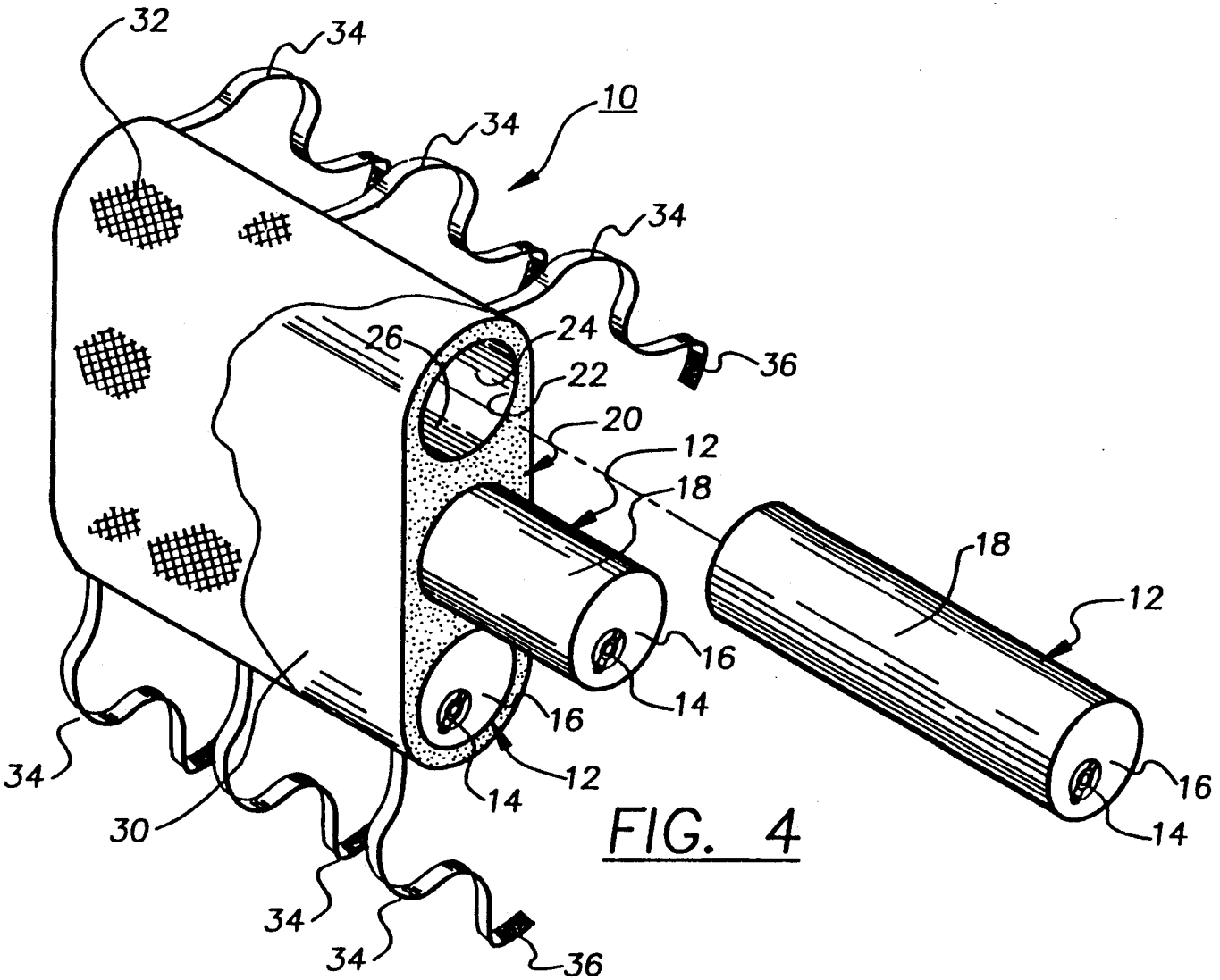

Referring now to FIGS. 1, 2 and 4, there is shown fluid cushion system 10 for contiguously interfacing and conforming to contours of a user's body. In general, fluid cushion system 10 may be used independently of other elements or in the alternative, may be used in conjunction with a chair seat, chair back, lorry, or striker frame at the discretion of the user.

In overall concept, fluid cushion system 10 allows for force loading to be applied and permits contouring to apply reactive forces to the user's body in a manner which allows an absorption and dispersal of forces over an increased body surface area to provide comfort to the body interfacing area of the user.

In further generalized concept, fluid cushion system 10 solves a multiplicity of problems through use of a plurality of concatenating elements in combination to provide an easily transportable fluid cushion system 10 which is applicable and mountable on a multiplicity of external base members of varying size and design from chair backs, seats, to flooring.

Fluid cushion system 10 includes fluid casing member 12 which is adapted to be at least partially filled with a liquid. Although not important to the inventive concept as herein described, the liquid being inserted into liquid casing member 12 may be water or some other incompressible fluid composition. Fluid casing member 12 is generally formed of a material composition which is impervious to the liquid being inserted therein. Casing 12 may be formed of a closed cell plastic composition such as polyethylene or other types of plastic members which allows for resilience of the overall casing member 12 while maintaining structural integrity to contain the liquid therein. It is important that the material composition of fluid casing member 12 be flexible or resilient in nature to allow for force loading and resilience thereof as the fluid is moved or shifted from one position or location to another.

The overall geometric contour of fluid casing member 12 may be of a cylindrical contour as is shown in FIGS. 1 and 4, or in the alternative, may be oval in cross-section dependent upon a number of parameters such as the amount of liquid being inserted therein, the overall physical constraints applied to fluid cushion system 10, as well as geometric considerations.

Fluid casing member 12 includes valve member 14 which is standard in the art and may be merely a standard plug valve well-known in the art, to allow insert and containment of the liquid within fluid casing member 12. Once liquid is inserted within fluid casing member 12, plug valve 14 may be closed as is shown in FIGS. 1 and 4 to maintain or capture the liquid internal to fluid casing member 12.

Plug valve 14 may be formed on an end wall 16 or within sidewall 18 not important to the inventive concept as herein described, with the exception that plug valve member 14 not impede the insert or retraction of fluid casing member 12 from the overall fluid cushion system 10.

Thus, in overall concept, resilient fluid casing member 12 is seen to be formed of generally a closed cell plastic composition material in the preferred mode and includes a valve mechanism such as plug valve 14 formed within an external wall 16 or 18 of fluid casing member 12 for selective insertion and removal of liquid respectively into and out of resilient fluid casing member 12.

Fluid cushion system 10 further includes resilient housing 20 for providing structural support for fluid casing member 12 substantially independent of the positional orientation of fluid casing member 12 whether in a horizontal or vertical positional location. As can be seen in FIGS. 1, 2 and 4, fluid casing member 12 is received within resilient housing 20 and may be removed therefrom at the discretion of the user.

Resilient housing 20 provides for a plurality of objectives and purposes which are important to the inventive concept as herein described. Initially, resilient housing 20 is provided to give a flexible housing for interfacing with the body of a user. Such flexibility is of importance where reactive forces are being applied to the user's body and such must be dispersed in a plurality of directions to minimize stress loading on the user's body.

Additionally, and of great importance, is the fact that liquid is inserted within fluid casing member 12. When fluid casing member 12 is oriented in varying positional locations, gravity assist becomes an important parameter due to the fact that fluid casing member 12 in itself is flexible and is deformed by gravity assist of the liquid contained therein. Thus, as can be clearly seen, when a plurality of fluid casing members 12 are mounted in a vertical direction and filled with liquid, generally such forms teardrop cross sectional contours with the liquid passing to the bottom of each fluid casing member 12. This teardrop type effect is not optimum for the dispersement of the fluid or the liquid at the upper portion of each fluid casing member 12 and such will not be dispersed or displaced in an optimum manner.

Thus, a second and concatenating objective of resilient housing 20 is to provide a structural support to aid in the overall structural integrity of fluid cushion system 10 and maintain a substantially uniform contour of fluid cushion system 10 independent of the orientation of fluid cushion system 10 whether such be in a horizontal plane or in the alternative, in a vertical plane, or further, in any positional location therebetween.

In order to provide the structural integrity of resilient housing 20 while at the same time maintaining flexibility, it has been found that resilient housing 20 may be formed in one piece formation of a flexible open cell material composition. Generally, an open cell plastic foam type rubber composition may be used with the important criteria that such have a sufficient structural integrity to maintain its general contour subject to the insertion of liquid within fluid casing members 12 while providing a flexible outer covering and conforming housing for the plurality of fluid casing members 12 as shown in FIGS. 1 and 4.

Resilient housing 20 includes a plurality of through passages 22 defining housing compartments adapted to receive respective resilient fluid casing members 12 therein. Each of housing compartments 22 include a predetermined contour for mating engagement with a respective resilient fluid casing member 12, as is shown. As can be seen, the contour of through passages or compartments 22 define a compartment inner wall member 24.

Housing compartment inner wall members 24 are generally coated with a liquid impervious coating layer 26. Coating layer 26 may be an acrylic coating or some other closed cell coating layer to prevent liquid from seeping into the open cells of resilient housing 20 in the event of leakage from fluid casing members 12.

Fluid cushion system 10 further includes structural support 28 for increasing the structural integrity of resilient housing 20 constituting a structural support mechanism for the overall system 10 providing a means whereby gravity assist force liquid shapings are minimized. Structural support 28 is formed between consecutively positioned housing compartments 22. Structural support 28 may be formed of a threaded stitch member for joining and compressing opposingly positioned outer wall members 30 of resilient housing 20.

In this manner, where structural support 28 is included between consecutive compartments 22, housing outer walls 30 form a scalloped cross-sectional contour, as is clearly seen in FIGS. 1 and 2.

In the embodiment shown in FIG. 4, fluid cushion system 10 has a resilient housing 20 which includes a pair of opposing outer wall members 30 which are substantially planar in contour and extend adjacent at least one of resilient fluid casing members 12, as is shown. In this embodiment, additional structural integrity of resilient housing 20 is provided by increased material in areas adjacent through passages or compartments 22 within which fluid casing members 12 are inserted and removed. Additionally, flexibility of resilient housing 20 is maintained through the generally open cell network forming the composition of housing 20.

Fluid cushion system 10 further includes fluid cushion cover member 32 which extends around resilient housing 20 in a substantially closed contour manner. Fluid cushion cover 32 may be formed of a textile material composition or some like composition, not important to the inventive concept as herein described with the exception that such provide an aesthetically pleasing covering for the combined fluid casing member 12 and resilient housing 20.

Additionally, fluid cushion cover 12 includes means for releasably securing fluid cushion system 10 to an external base member which may be a chair or some like article of furniture to which the user wishes fluid cushion system 10 to be mounted in relatively stable positional location.

The mechanism for releasably securing fluid cushion system 10 to an external base member may include strap members 30 which are coupled to fluid cushion cover 32 to allow contiguous interfacing with the external base member. Strap members 34 may be secured to fluid cushion cover 32 through threaded securement, or some like technique. As can be seen in FIG. 1, strap members 34 may include Velcro ends 36 which may pass around the external base member and be secured each to the other for mounting of fluid cushion system 10 in a relatively stable position on the external base member.

Alternatively, fluid cushion cover 32 may include sleeve member 38 extending from a rear portion thereof as shown in FIG. 2, for at least partial insert over a base member in order to maintain fluid cushion system 10 in a relatively stable positional location on external base member. Thus, where the external base member is the back of a chair, sleeve member 38 may be passed over the seat back and such will positionally locate the plurality of fluid casing members 12 in a substantially vertical alignment within flexible or resilient housing 20.

In operational use, the user may initially fill each of fluid casing members 12 with a liquid to a predetermined level dependent upon the needs of the user. Obviously, where the user wishes a less deformable fluid cushion system 10, fluid casing members 12 would be filled substantially throughout the internal volume. Where a more resilient and flexible or spongy type of system 10 is desired, less liquid is inserted within fluid casing members 12. Obviously, plug valves 14 are opened during the filling procedure and are then closed as is shown in FIGS. 1, 2 and 4.

Alternatively, at the discretion of the user, fluid casing members 12 may be initially inserted within through passages or compartments 22 in a deflated or empty condition and then filled while maintained within flexible or resilient housing 20.

Fluid cushion cover 32 may be fitted over resilient housing 20 and then attached to an external base member through strap members 34 or through attachment by sleeve member 38, or some like technique, not important to the inventive concept as herein described.

In use, as the user applies a body force against the plurality of fluid casing members 12, liquid contained therein is displaced in a manner which allows conformance to the body part interfacing with fluid cushion system 10. Structural support provided by flexible and resilient housing 20 maintains the fluid or liquid contained within each fluid casing member 12 substantially in an independent manner and allows for greater comfort to the user than that known for other prior art systems.

Figure 3:
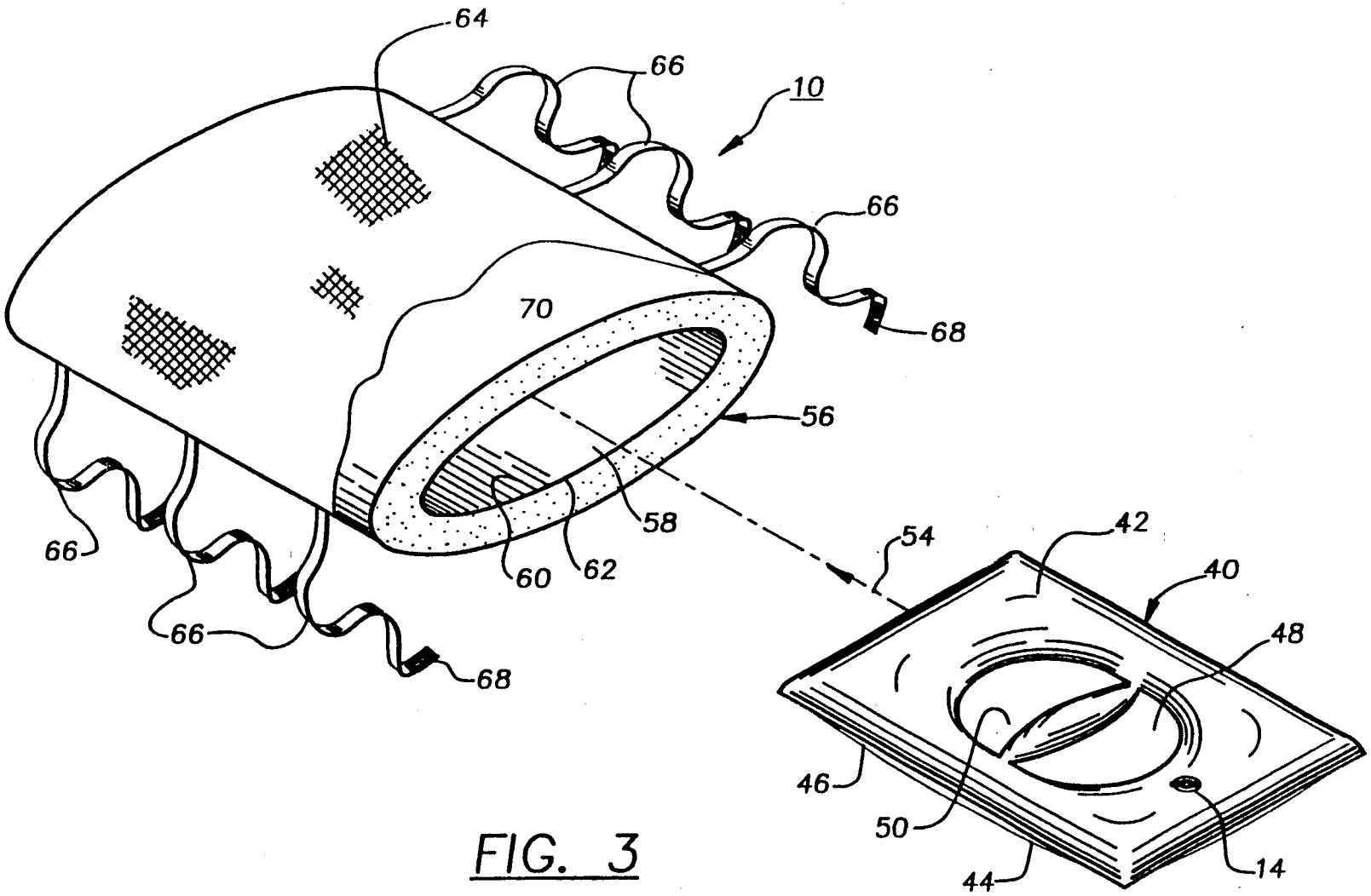
FIG. 3 a perspective view of an embodiment of the fluid cushion system shown in exploded view; and, FIG. 4 is an exploded perspective view partially in cut-away showing a fluid cushion system using a resilient housing having opposing transversely displaced substantially planar surfaces.

Referring now to FIG. 3, there is shown fluid cushion system 10' which is an embodiment of fluid cushion system 10 shown and described in FIGS. 1, 2 and 4. Fluid cushion system 10' is generally directed to a seating fluid cushion for interface with the backside of a user, however, fluid cushion system 10' may be used in operation for interfacing with any of the body parts of a user, as was previously discussed and described for fluid cushion system 10.

Fluid cushion system 10' includes resilient fluid casing 40 which as was the case for fluid casing member 12, is adapted to be at least partially filled with a liquid. Resilient casing member 40 is generally formed of a material composition impervious to liquid and defines an internal chamber adapted to contain and maintain liquid therein. Liquid may be inserted into resilient casing member 40 through plug valve member 14' as was previously described for valve 14 of fluid cushion system 10.

As can be seen in FIG. 3, resilient casing member 40 is generally formed in a substantially rectangular baglike contour. Resilient casing member 40 further includes an internal fluid volume interrupted in fluid communication within predetermined areas. Resilient fluid casing member 40 is formed of a liquid impervious composition generally formed of a closed cell plastic material such as polyethylene, or some like composition not important to the inventive concept as herein described, with the exception that the composition of casing member 40 have sufficient structural integrity to accept the applied loads.

Resilient casing member 40 includes casing member upper surface 42 and casing member lower surface 44 which may be joined along heat seal 46 extending around the outer periphery of resilient casing member 40. The joining of lower surface 44 to upper surface 42 may be through a number of well-known techniques, not important to the inventive concept as herein described, with the exception that the seal provide for an internal chamber and that such seal is liquid impervious.

Resilient casing member 40 includes a pair of non-fluid contained sections 48 and 50 defining a pair of crescent shaped contours having fluid communication conduit 52 passing therebetween. Fluid communication conduit 52 allows fluid communication between opposing transverse portions of the internal chamber containing liquid. Additionally, fluid communication conduit 52 has a varying dimension in the longitudinal direction defined by directional arrow 54.

Non-fluid containing sections 48 and 50 may be formed by joining upper surface 42 to lower surface 44 of resilient casing member 40 within the crescent shaped contours shown. Joining may be by heat sealing upper and lower surfaces 42 and 44 or through some other technique, not important to the inventive concept as herein described, with the exception that in nonfluid sections 48 and 50, that there be no liquid containing chamber volume. In other ways of forming nonfluid sections 48 and 50, such may be formed of a singular sheet of plastic which is joined to upper and lower surfaces 42 and 44 at the periphery of crescent shaped non-fluid sections 48 and 50.

The varying dimension of fluid communication conduit 52 with respect to longitudinal direction 54, is of importance in that such varying volume contour allows for insertion between the buttocks of a user and allows conforming displacement of the contained liquid in a rapid and resilient loading manner.

Further regarding fluid cushion system 10', it is clearly seen from FIG. 3 that resilient casing member 40 is insertable within resilient housing 56 and insertion of resilient casing member 40 within through passage 58 defining an internal compartment.

Resilient housing 56 provides structural support for fluid casing member 40 substantially independent of a positional orientation of fluid casing member 40 when fluid casing member 40 is received within resilient housing 56.

Resilient housing 56 is generally formed in a cross-sectional oval contour for insertion of resilient casing member 40. Additionally, resilient housing 56 may be formed of a flexible open cell material composition, as was the composition material for resilient housing 20, previously described. Still further, resilient housing 56 may include coating layer 60 and on an inner wall 62 to prevent passage of liquid from resilient casing member 40 into the possible open cell network of resilient housing 56.

Cover member 64 is shown in FIG. 3 to provide an overall covering in closed contour fashion around flexible housing 56. Cover member 64 may be formed of a standard textile material which may be used to provide an aesthetically pleasing covering for resilient housing 56 and possible extended life use to minimize abrasion of outer wall 70 of flexible housing 56.

Resilient or flexible housing 56 further includes securement mechanism 66 for securement of fluid cushion system 10' to an external base member. As was the case for fluid cushion system 10, system 10' may include a plurality of strap members 66 extending from and attached to opposing transverse sides of fluid cushion system 10', as is shown. Strap members 66 may be mounted around an external base member and secured each to the other through a securement system such as Velcro members 68. Velcro members 68 may be attached to respective strap members 66, or in the alternative, may be releasably mounted to other Velcro members which are secured to the external base member.

In this manner, fluid cushion system 10' provides for a resilient and flexible cushioning system which may be utilized for efficiently displacing force loading applied thereto through respective displacement of liquid contained within casing member 40. Further, through the unique contouring, flexible casing member 40 provides for a relief of pressure sensitive areas of a user within an area between the buttocks.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A fluid cushion system comprising:

(a) at least one fluid casing member adapted to be at least partially filled with a liquid, said fluid casing member being formed of a material composition impervious to said liquid, said fluid casing member being formed in a substantially rectangular bag like contour, said fluid casing member including an internal fluid volume being interrupted in fluid communication, said resilient fluid casing member further including a pair of non-fluid contained sections having a longitudinally extended fluid communication conduit passing therebetween, said fluid communication conduit having a varying cross-sectional area dimension in said longitudinal direction for providing relief of pressure sensitive areas of a user; and, (b) a resilient housing for providing individual structural support for said at least one fluid casing member substantially independent of a positional orientation thereof, said fluid casing member being received within said resilient housing, said fluid casing member being insertable and retractable from said resilient housing, said fluid cushion system being adapted to be removably secured to a base surface, said resilient housing including means for structural support defined by housing walls being formed of a flexible open cell material composition in one piece formation.

* * * * *